US005108088A

United States Patent [19]

Keller et al.

[11] Patent Number: 5,108,088

[45] Date of Patent: * Apr. 28, 1992

[54] EXERCISE DEVICE WITH UNDERWATER TREADMILL

[75] Inventors: Jeff Keller; Robert Linton, both of Edmonds, Wash.

[73] Assignee: Stewart Medical, Inc., San Antonio, Tex.

[ * ] Notice: The portion of the term of this patent subsequent to Jul. 31, 2007 has been disclaimed.

[21] Appl. No.: 559,474

[22] Filed: Jul. 30, 1990

Related U.S. Application Data

[63] Continuation of Ser. No. 273,656, Nov. 18, 1988, Pat. No. 4,944,506, which is a continuation of Ser. No. 163,174, Feb. 26, 1988, abandoned, which is a continuation of Ser. No. 13,835, Feb. 12, 1987, abandoned.

[51] Int. Cl.[5] ..... A63B 22/02

[52] U.S. Cl. ..... 482/5; 4/507; 482/4; 482/54; 482/78; 482/111

[58] Field of Search ..... 272/69, 71; 119/29, 119/158; 4/492, 494, 496, 493, 507-510, 541-544, 546, 548, 555-556; 128/25 R, 25 B

[56] References Cited

U.S. PATENT DOCUMENTS

| | | | |
|---|---|---|---|
| 1,046,813 | 12/1912 | Laugenour | 272/26 |
| 2,400,439 | 5/1946 | Romans | 210/765 |
| 2,611,341 | 9/1952 | Paris | 119/158 |
| 2,739,939 | 3/1956 | Leslie | 210/127 |
| 3,371,354 | 3/1968 | Hayslett | 4/556 |
| 3,485,213 | 12/1969 | Scanlon | 119/29 |
| 3,534,413 | 10/1970 | Plasseraud | 272/71 X |
| 3,663,971 | 5/1972 | Bonhote | 4/556 |
| 3,709,197 | 1/1973 | Moseley | 119/29 |
| 3,801,992 | 4/1974 | Sable | 4/509 |
| 3,809,003 | 5/1974 | Foldvari | 272/69 X |
| 3,839,751 | 10/1974 | Bressler | 4/509 |
| 4,034,424 | 7/1977 | Budlong | 4/540 |
| 4,183,329 | 1/1980 | Leonaggeo, Jr. | 119/158 |
| 4,197,815 | 4/1980 | Brazelton | 119/29 |
| 4,332,217 | 6/1982 | Davis | 119/29 |
| 4,360,935 | 11/1982 | Barrett, Sr. | 4/555 |
| 4,379,438 | 4/1983 | Peardon | 119/29 |
| 4,389,739 | 6/1983 | Baker | 4/508 X |
| 4,529,033 | 7/1985 | Blum | 4/493 X |
| 4,534,192 | 8/1985 | Harshbarger et al. | 70/118 |
| 4,712,788 | 12/1987 | | Gaudreau |
| 4,776,589 | 10/1988 | Shepherdson | 272/69 X |
| 4,944,506 | 7/1990 | Keller et al. | 272/69 |

FOREIGN PATENT DOCUMENTS 1201342 3/1986 Canada .

OTHER PUBLICATIONS

Brochure of D. L. Hansen, Inc., titled Aquaciser TM, publication date unknown, St. Charles, Ill.

*Primary Examiner*—Richard J. Apley
*Assistant Examiner*—D. F. Crosby
*Attorney, Agent, or Firm*—Christensen, O'Connor, Johnson & Kindness

[57] ABSTRACT

Upright sidewall and end panels are bolted to a unitary base component having a treadmill so as to form a composite exercise tank. One end panel has a door of transparent sheet material with specialized hinges and locking mechanism to assure a leakproof fit. Water can be introduced into the tank to a desired level from a storage container, whereupon the treadmill is actuated for exercise or therapy. During use, water in the tank is recirculated through heating, cleaning and sanitizing equipment. After use, the water in the tank is emptied to the storage container and the user exits through the door.

9 Claims, 7 Drawing Sheets

Fig. 6.
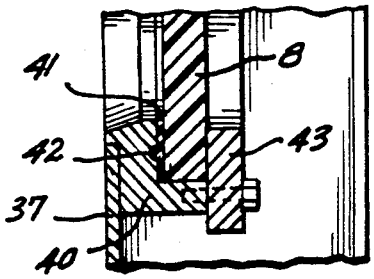
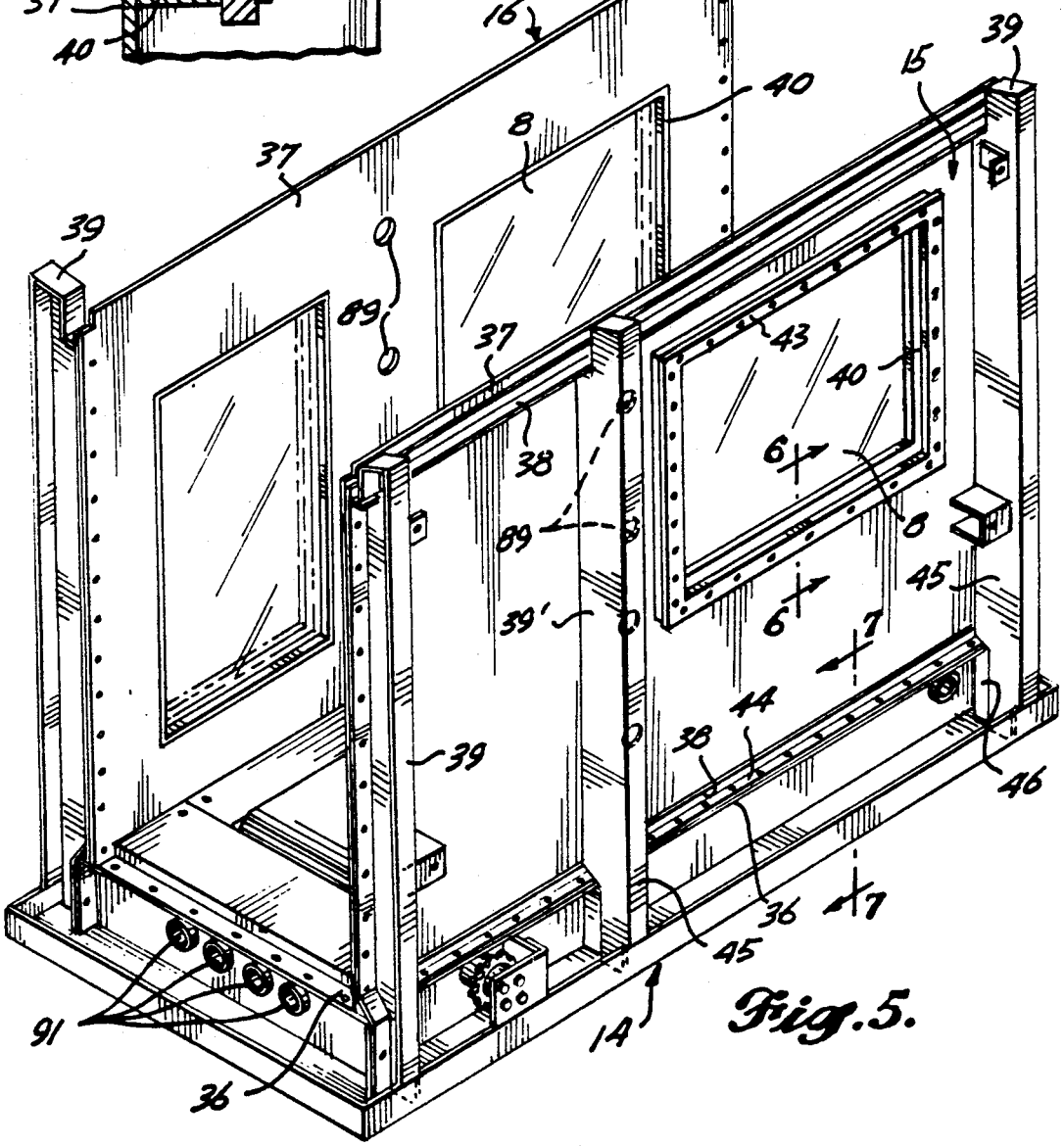
Fig. 5.

EXERCISE DEVICE WITH UNDERWATER TREADMILL

CROSS REFERENCE

This is a continuation of our co-pending application Ser. No. 273,656, filed Nov. 18, 1988, for Exercise Device With Underwater Treadmill, issued Jul. 31, 1990 as U.S. Pat. No. 4,944,506, which is a continuation of co-pending application Ser. No. 163,174, filed Feb. 26, 1988, now abandoned, which is a continuation of co-pending application Ser. No, 013,835, filed Feb. 12, 1987, now abandoned.

FIELD OF THE INVENTION

The present invention relates to an exercise and therapy device of the treadmill type. More specifically, the present invention relates to an exercise tank having an underwater treadmill for exercise and therapy as the user walks against the resistance of water in the tank and is buoyed to reduce jarring.

PRIOR ART

Hansen Canadian patent No. 1,201,342, issued Mar. 4, 1986, and the U.S. patents listed below disclose water tanks or pools for bathing or exercising horses:

Paris patent No. 2,611,341, issued Sep. 23, 1952;

Scanlon patent No. 3,485,321, issued Dec. 23, 1969;

Leonaggeo, Jr., U.S. Pat. No. 4,183,329, issued Jan. 15, 1980;

Brazelton U.S. Pat. No. 4,197,815, issued Apr. 15, 1980; and

Davis U.S. Pat. No. 4,332,217, issued Jun. 1, 1982.

Of these, the Hansen Canadian patent and the Scanlon and Davis U.S. patents disclose underwater treadmills.

There has been at least one prior attempt to provide a tank with an underwater treadmill for exercise and therapy of humans, namely, the tank advertised under the trademark AQUACISER by D. L. Hansen, Inc., of St. Charles, Ill.

SUMMARY THE INVENTION

It is an object of the present invention to provide a novel exercise and therapy device of the type having a water tank and an underwater treadmill and of reliable, durable and leakproof construction.

Another object is to provide such a device in a form eliminating or greatly lessening the probability of damage to surrounding areas should a small leak occur during normal use.

It also is an object to provide such a device in a form convenient and safe to use, requiring a minimum of supervision by an attendant or therapist.

An additional object is to provide such a device in which the tank can be filled and drained as quickly as possible without unnecessary duplication of components such as pumps.

A further object is to provide such a device in compact form for storage, and for shipment to a location where it is to be installed, including movement through standard hallways and doorways.

Still another object is to provide such a device usable for physical evaluation by observing the gait of the user from different angles.

In the preferred embodiment of the present invention the foregoing objects are accomplished by an exercise device with an underwater treadmill of knockdown construction so that it can be manufactured, stored and shipped in a few component pieces. The kit of components is easy to assembly at the installation location to substantially watertight condition. Such kit can include identical storage tanks that can be secured together with their interiors in communication through a conduit to form a larger composite storage container for water for an open-topped exercise tank. The exercise tank can include a unitary bottom component containing the treadmill. Upright sidewall and end wall panels can be bolted to the bottom component and to the adjacent panels. The sidewalls have windows and nozzles through which aerated water can be injected. One end wall has an underwater light to aid in observing the user. The other end wall has a door of transparent sheet material for head-on viewing. The door has specialized hinges and locking mechanism to assure a leakproof fit. The unitary bottom component has a peripheral trough in which water will collect should any leaks occur, rather than running onto the surrounding supporting surface. A sensor in the trough warns of a high water level so that the trough can be drained.

A cabinet is mounted on the composite storage container and contains pumps, a filter, a heater and a bromine injector interconnected with the container, the exercise tank and each other by conduits and motorized valves. Preferably only two pumps are provided, both of which can be used for filling and for draining the exercise tank even though neither pump is reversible. One of the pumps also can be used to ciruclate water from storage through the filter, heater and bromine injector and back to storage, which is useful in preheating, cleaning and sanitizing water to be pumped into the exercise tank. The other pump, in addition to being used during filling and draining operations, can be used to draw water from the exercise tank and inject it through the side panel nozzles to agitate the water in the tank.

BRIEF DESCRIPTION OF THE DRAWINGS

FIG. 5 is a top perspective of the unitary base unit of the exercise tank with the two sidewall panels in position to be attached;

FIG. 6 is an enlarged section along line 6—6 of FIG. 5; and

Figure 1:
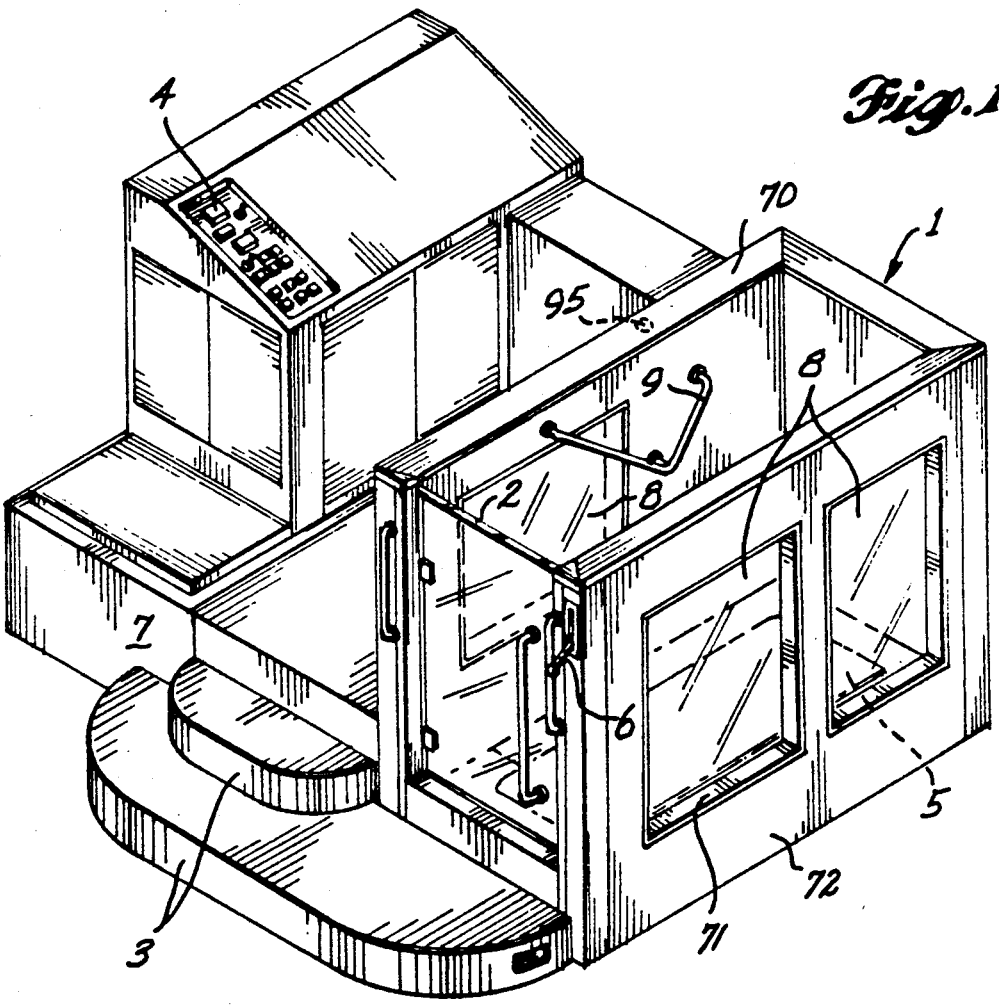
FIG. 1 is a somewhat diagrammatic top perspective of an exercise device with underwater treadmill in accordance with the present invention.

The user enters the exercise tank 1 through its door 2 onto the horizontal top run of an endless belt 5. The door 2 is closed and is locked by manipulation of a lever 6. The attendant actuates introduction of water into the exercise tank from an underlying composite storage container 7 until a desired level is reached. Preferably there is room for at least 3 feet to 4 feet (0.9 m to 1.2 m) of water in the tank above the treadmill belt 5, but for some applications a lesser height of water would be selected. The control panel is used to set the direction and speed of the treadmill belt, the temperature of the water, the duration of operation of the treadmill and accessories such as an underwater light and agitating and aerating jets. Windows 8 in the exercise tank sidewalls and the door 2 which preferably is of transparent plastic sheet material allow the attendant or therapist to evaluate the gait of the user. The window nearer the control panel also is of use to judge the desired height of water in the tank during filling. Hand rails 9 are provided inside the tank for the safety of the user. At the end of the exercising or therapy period, the tank is drained to storage and the user exits.

Figure 2:
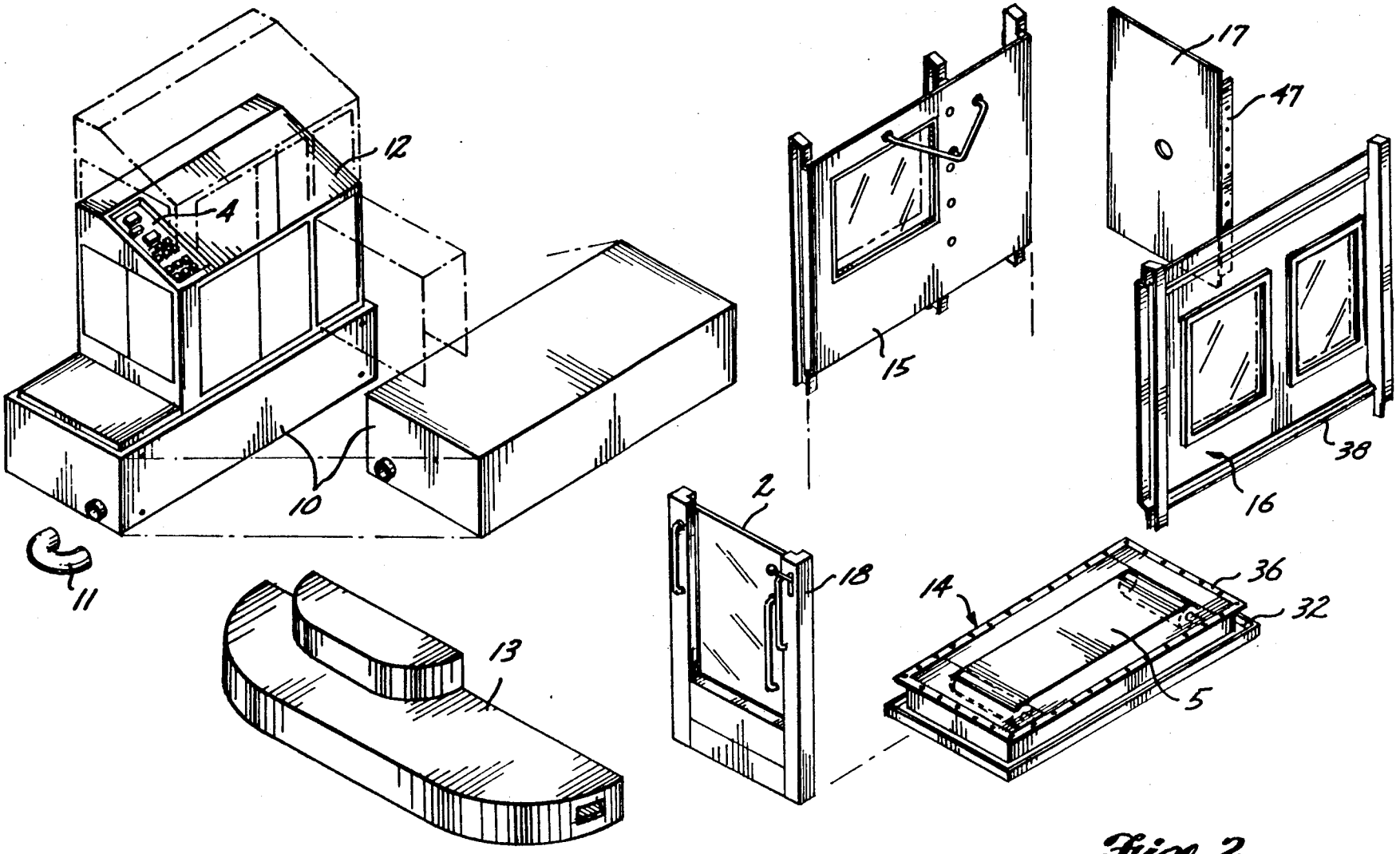
FIG. 2 is a corresponding top perspective of such device with some component parts shown in exploded relationship, including a first storage tank unit with overlying cabinet and control panel, a second storage tank unit, and an exercise tank formed by a unitary base unit and sidewall and end panels.

As diagrammatically represented in FIG. 2, a particular advantage of the present invention is its knockdown construction allowing it to be manufactured, stored and shipped in small pieces. For example, for most installations the pieces can be moved through standard hallways and doorways and in elevators to the installation location without cutting or further disassembly. At such location the pieces can be assembled without jeopardizing the durable, reliable and watertight character of the finished product.

The primary component parts are two substantially identical tanks 10 which can be secured together with their interiors in communication through one or more conduits 11 to form the composite storage container; a cabinet 12 with the exposed control panel 4, mounted on top of one of the tanks 10 and enclosing the pumps, filter, bromine injector, valves and circuitry described further below; the stair unit 13; and the exercise tank components, namely, the unitary base 14 in which the treadmill with its belt 5 is mounted, upright sidewall panels 15 and 16, a closed end panel 17 and a door end unit 18.

Figure 3:
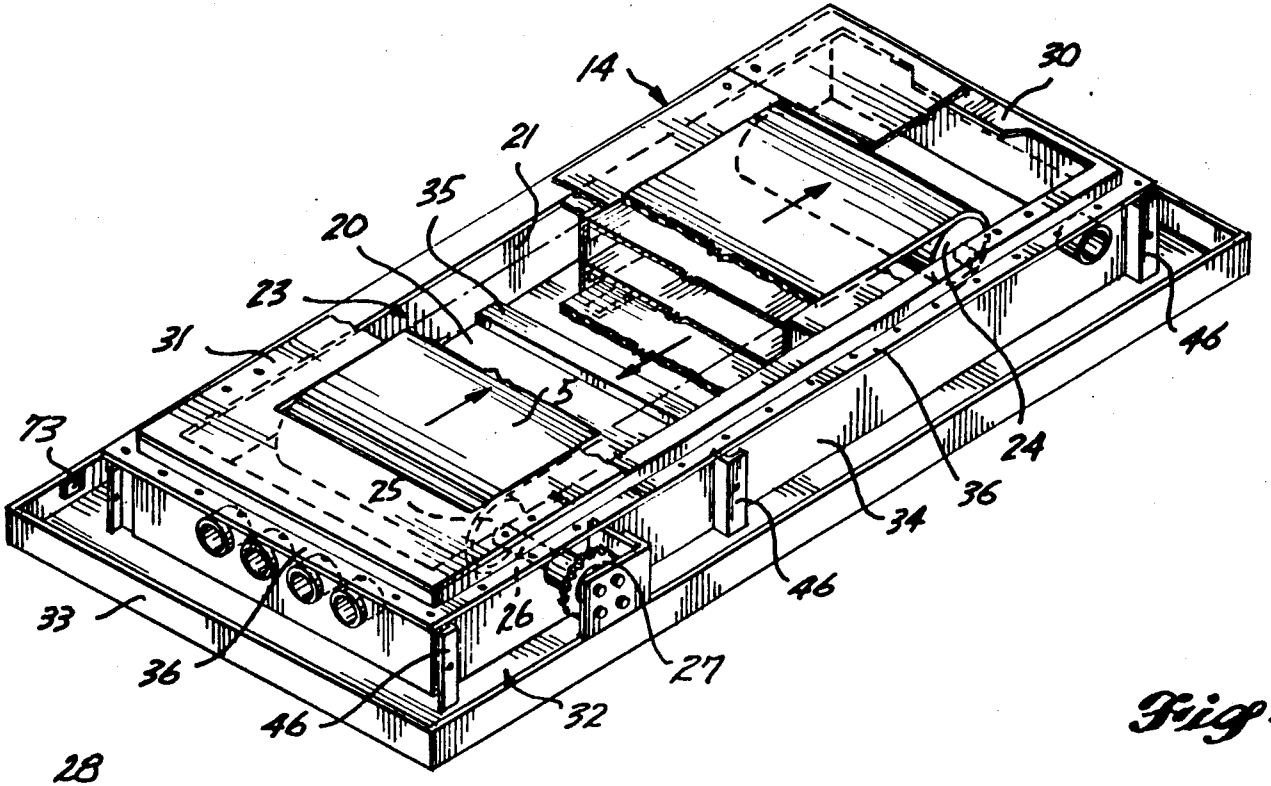
FIG. 3 is a top perspective of the exercise tank unitary base unit which includes the treadmill.
Figure 4:
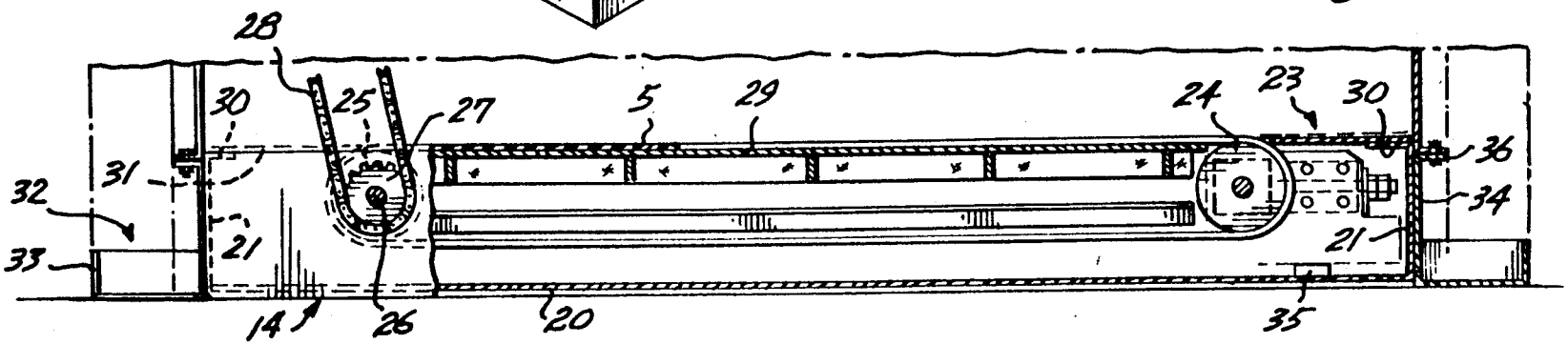
FIG. 4 is a fragmentary, longitudinal, vertical section of the bottom portion of the exercise tank of the device in accordance with the present invention, with parts broken away.

The unitary base 14 is shown in greater detail in FIGS. 3 and 4. It has a flat bottom 20 with upstanding walls 21 forming the inner cavity 23 in which the treadmill is mounted. The treadmill is of conventional design including an idler roller 24 at one end and a live roller 25 at the other around which the endless belt 5 extends. The live roller is driven by a drive shaft 26 extending through a watertight bearing and seal in one of the upright walls 21. The shaft carries an external drive sprocket 27. With reference to FIG. 4, such sprocket is driven by a chain 28 extending around another sprocket (not shown) which, in turn, is driven by an electric motor (not shown). Springs (not shown) bias the idler roller 24 away from the live roller to maintain the belt under tension. The treadmill includes a horizontal upper support member 29 with an antifriction top surface over which the top run of the belt 5 slides.

The bottom 20 of the unitary base 14 is stiffened by cross members 35. The top portions of the walls 21 are inturned to form horizontal flanges 30 for supporting the frame members 31 encircling and preferably flush with the top run of the belt 5. The frame members 31 at the opposite longitudinal sides of the belt are preferably at least about 4 to 5 inches (1.6 cm to 2 cm) wide to permit the user to step off the belt while inside the exercise tank.

The base 14 has an outer marginal portion 32 extending outward of the upright walls 21 all the way around the base. Such marginal portion has an outer upright rim 33 to form an open-topped trough and an inner upright wall 34 welded at the top and bottom to the adjacent wall 21. A horizontal support flange 36 extends outward from the unitary base component inner wall 21 slightly below the inner support flange 30.

With reference to FIG. 5, each of the exercise tank sidewall panels 15 and 16 has an inner sheet material skin plate 37, preferably stainless steel, stiffened at the top and bottom by horizontal angle braces 38 and at the corners by upright channel braces 39 which are welded to the plate. Additional stiffening is provided by the sash pieces 40 for the windows 8, best seen in FIG. 6, which pieces also are welded to the outer surfaces of the plates 37. The windows 8 fit in the sash pieces against resilient gasket strips 41 and are clamped inward to compress such strips, preferably into a continuous groove 42 encircling each window opening, by outer frame plates 43 bolted to the sash pieces. For panel 15 nearer the viewer in FIG. 5 an additional intermediate channel brace 39′ is provided adjacent to the nearer edge of the window. No intermediate brace is required for the opposite panel 16 because two tall windows are provided in that panel.

Figure 7:
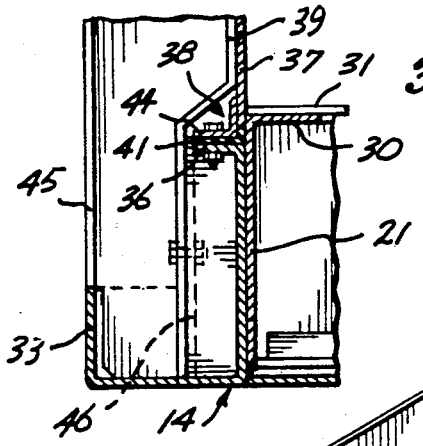
FIG. 7 is an enlarged section along line 7—7 of FIG. 5.

The horizontal angle brace 38 at the bottom edge portion of each skin plate 37 forms an outturned horizontal flange 44 to be supported on the corresponding flange 36 of the base 14. As best seen in FIG. 7, similar to the window construction, in securing the sidewall panels to the unitary base component 14, strips 41 of resilient gasket material are interposed between base and panel flanges 36 and 44 and are compressed to assure a watertight fit when such flanges are tightly bolted together. The bottom leg portions 45 of the upright channel braces 39 fit snugly in the peripheral trough of the base and preferably are notched over the rim 33. The inner edges of such leg portions are bolted to brackets 46 of the base projecting into the trough. Such brackets have outer upright edges substantially aligned with the outer edges of the support flanges 36 and contiguously engaged against the channel brace leg portions 45.

Figure 8:
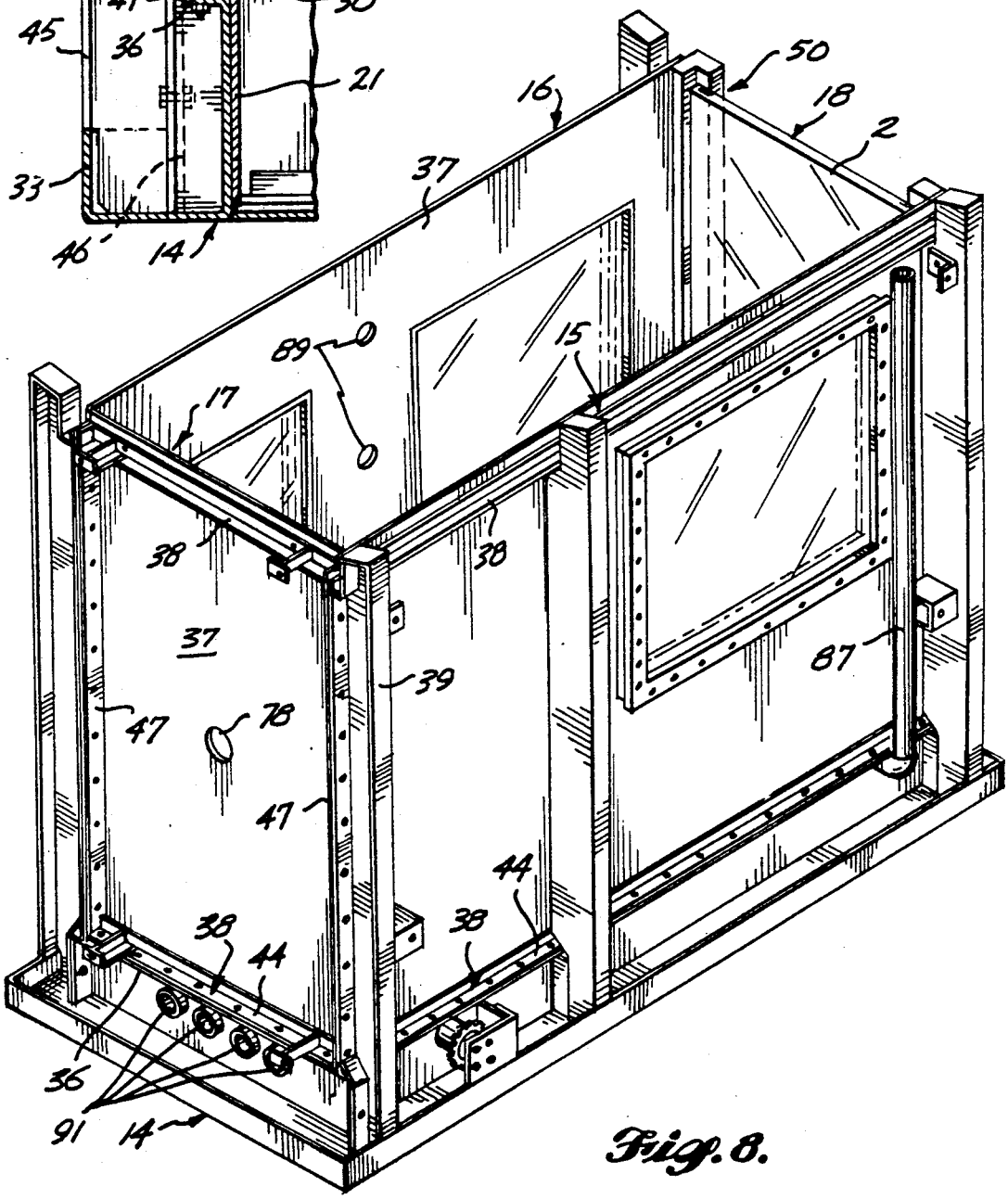
FIG. 8 is a top perspective corresponding to FIG. 5, but with the end panels in position for attachment to the unitary base unit and the sidewall panels.

With reference to FIG. 8, the closed end wall panel 17 also has an inner sheet material skin plate 37 with top and bottom angle braces 38. The upright edges of such plate are bent rearward to form outturned vertical flanges 47, at its opposite sides. The bottom angle brace 38 overlies the support flange 36 at the corresponding end of the unitary base 14 and is bolted to it to clamp an interposed strip of resilient gasket material. The vertical flanges 47 are bolted to the upright end margins of the sidewall panels 15 and 16, again with interposed, clamped strips of resilient gasket material to assure a watertight seal.

Figure 9:
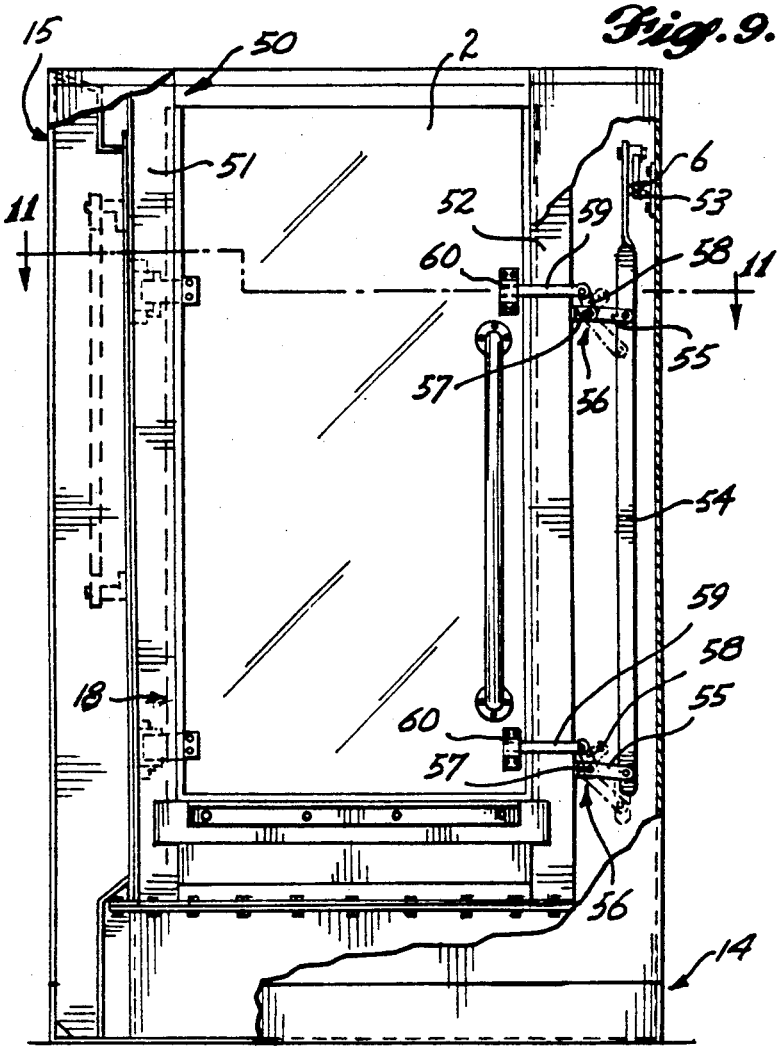
FIG. 9 is an end elevation of the front or door end of the exercise tank, with parts broken away to illustrate the door locking mechanism.
Figure 10:
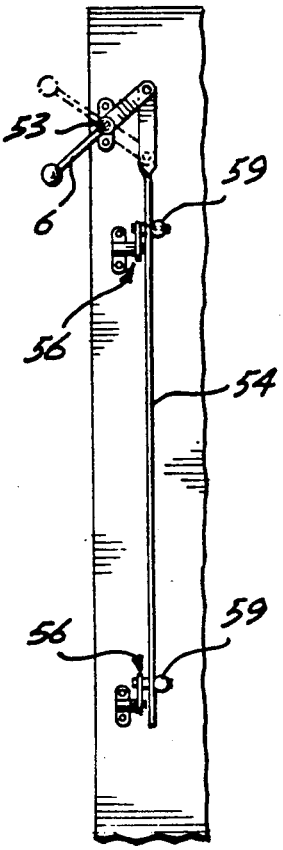
FIG. 10 is a fragmentary side elevation of such end portion, with parts broken away to illustrate such door locking mechanism from the side.
Figure 11:
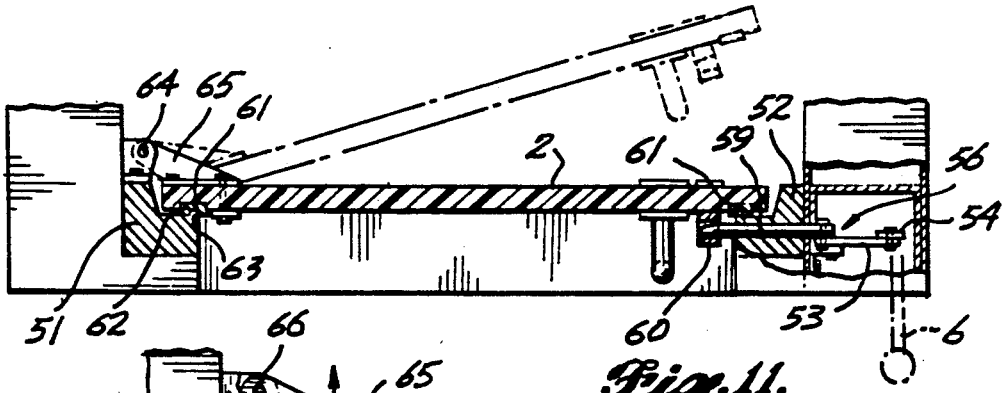
FIG. 11 is a horizontal section along line 11—11 of FIG. 10.

At the other end of the exercise tank, the door end unit 18 is fitted and similarly bolted to the adjacent end margins of the sidewall panels 15 and 16 at the base 14 with the interposed strips of resilient gasket material. As seen in FIG. 9, such end unit 18 forms a U-shaped frame 50 for the central door 2 which preferably is of transparent plastic sheet material. As best seen in FIG. 11, the door is hinged to the upright frame member 51 at one side for swinging into the exercise tank. The other side of the door has an outward-projecting handle and the upright frame member 52 at that side has internal lock-actuating mechanism controlled by the lever 6. With reference to FIG. 10, up and down movement of the lever 6 about its fixed pivot 53 translates a long upright link 54 substantially vertically. Returning to FIG. 9, such link 54 is pivotally connected to the generally horizontally projecting legs 55 of bell cranks 56 having apex portions pivoted on fixed pins 57. The bell cranks have upright legs 58 pivotally connected to horizontal locking pins 59. Such locking pins are slidable in bores through the frame member 52 to project inward into eyes of brackets 60 mounted on the door or to retract into the frame member 52 and thereby allow the door to be swung inward for entrance to or exit from the exercise tank.

Figure 11A:
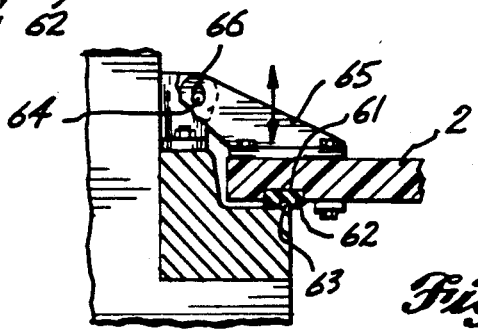
FIG. 11*a* is an enlarged fragmentary detail of the left portion of FIG. 11.

With reference to FIGS. 11 and 11*a*, the outer face of the door 2 has a continuous groove 61 along its upright and bottom margins. A thick strip 62 of resilient sealing material is secured in the groove and projects outward toward the door frame. When the door is closed, such strip engages against and is compressed by a short, narrow, inward-projecting lip 63 of the frame centered with respect to the door groove 61.

As the exercise tank is filled with water, substantial water pressure is applied against the door tending to move it outward to further compress the strip 62. The door hinges and locking mechanism are designed to permit such movement which increases the watertightness of the door as the tank is filled and assures that the increasing force is applied to the door frame and not to the hinge pins 64 and the locking pins 59. As seen in FIG. 11, when the door is first closed and locked, each locking pin 59 is engaged against only the outer edge of the eye in its bracket 60, and there still is space between the inside upright edge of the pin and the adjacent edge of its eye. Similarly, as seen in FIG. 11*a*, each hinge arm 65 connected to the opposite margin of the door has a slightly elongated hole 66 receiving its hinge pin 64 such that, when the door is closed initially, the hinge pin engages against the outer edge of the hole but there is space in such hole toward the inside of the tank. The result is that the door can shift outward as the tank is filled, moving the hinge arms 65 and door brackets 60 outward relative to the hinge pins 64, and locking pins 59 and further compressing the resilient sealing strip 62.

With reference to FIG. 1, additional nonstructured pieces are added during final assembly of the exercise tank, including the top stainless steel apron 70, similar stainless steel window moldings 71 and the nonstructural outer sheet metal skin 72 which can be enamel coated. Despite careful assembly it is recognized that a small leak could possibly occur, but any water from such a leak would collect in the peripheral trough of the exercise tank base. Preferably, a water sensor and alarm unit 73, diagrammatically shown in FIG. 3, is provided to detect and signal when the trough is almost full so that it will be drained before overflowing.

Figure 12:
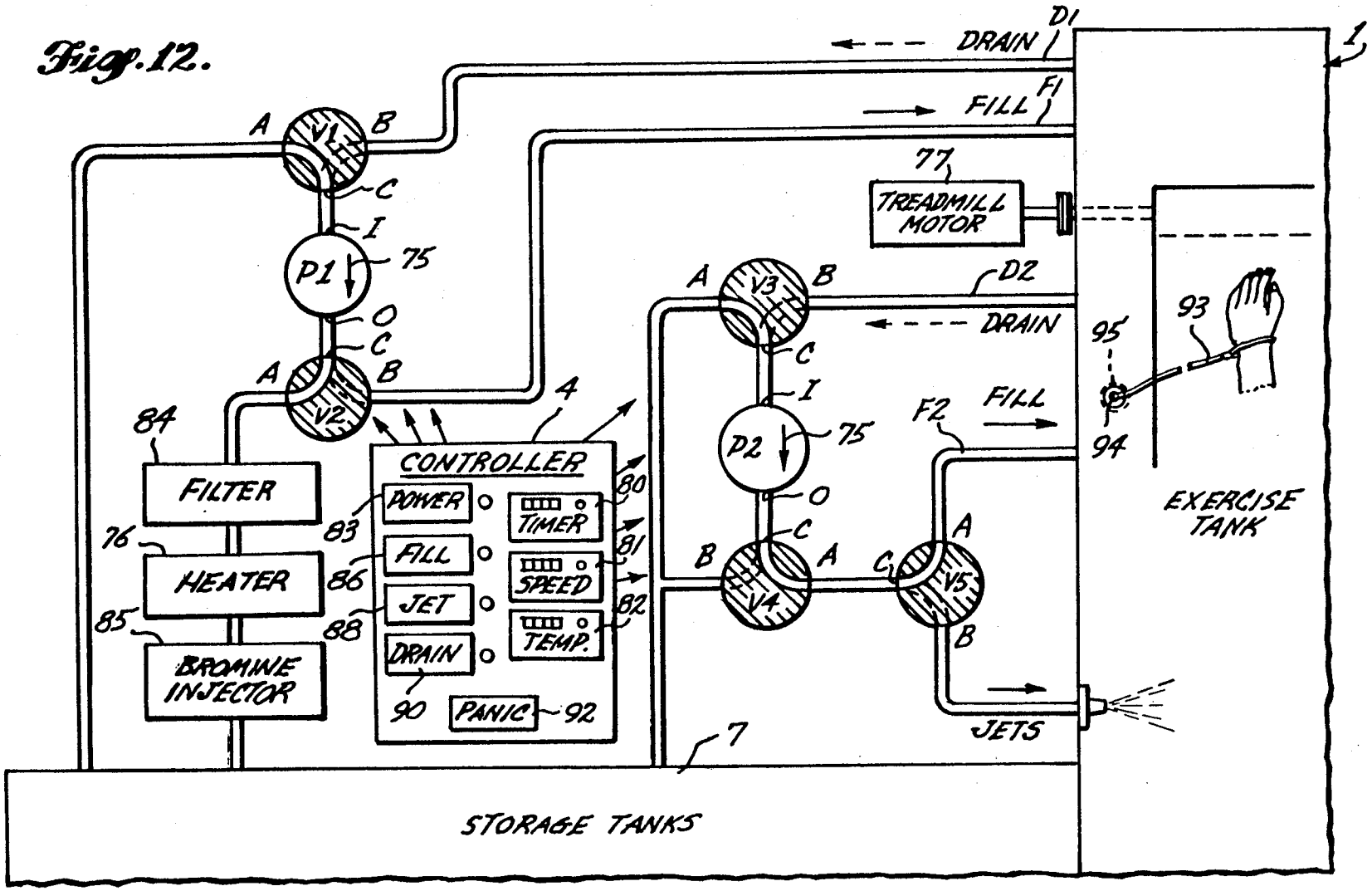
FIG. 12 is a hydraulic circuit diagram of the exercise device in accordance with the present invention with various components illustrated diagrammatically. DETAILED DESCRIPTION As illustrated in FIG. 1, the exercise device with underwater treadmill in accordance with the present invention includes a large, open-topped, rectangular exercise tank 1 having a door 2 in one end. In a representative installation, the exercise tank can be about 80 inches (203 cm) long by about 40 inches (102 cm) wide and about 62 inches (157 cm) high. There are stairs 3 for convenient access to the exercise tank by the user. The stairs also provide convenient access to a raised control panel 4 which is used by an attendant or a therapist.

The plumbing connections, circuitry and operation of the device in accordance with the present invention are best described with reference to FIG. 12. There are two pumps P1 and P2 each effective to pump only in the single direction indicated by the arrows 75 from an inlet I to an outlet O, and five 3-port, electrically operated, motorized valves V1, V2, V3, V4 and V5, each having a common port C connectible to either of two other ports A or B. For ease of illustration and explanation, the solid line positions indicated in FIG. 12 for the valve V1 through V5 are designated as the A positions, and the broken line positions are designated as the B positions. Illustrated diagrammatically in FIG. 12 is the control panel 4 which also represents the conventional controller used to actuate the pumps, valves, a conventional water heater 76, the treadmill motor 77 and other accessories such as an underwater light which can fit in the central hole 78 of the tank closed end panel 17 seen in FIG. 8. One section 80 of the control panel includes mechanism for setting a timer to actuate the treadmill motor for a given period of time. Another section 81 is used to set the speed of the treadmill motor. Another section 82 is used to set the water temperature, i.e., actuate the heater 76 if the water temperature is below a desired temperature. The direction of the treadmill motor also can be selected.

At start up the "power" button 83 of the control panel is depressed which actuates pump P1 and moves valves V1 and V2 to their solid line positions shown in FIG. 12. In such position water is drawn from one of the storage tanks through valve V1 to the pump inlet and is discharged by the pump through valve V2, a conventional filter 84, the heater 76 and a conventional bromine injector 85 for sanitation. The constant recycling of the water is particularly advantageous for preheating it prior to introduction into the exercise tank.

When it is desired to fill the exercise tank, the "fill" button 86 is pressed which causes valve V2 to move to its broken line position where ports C and B are connected. The other valves remain or are moved automatically to their solid line positions as seen in FIG. 12 and pump P2 is automatically actuated. Pump P1 continues to draw water from storage, but valve V2 in its broken line or B position causes such water to be discharged through line F1 into the exercise tank. At the same time, pump P2 draws water from storage through valve V3 and discharges such water through valves V4 and V5 into the exercise tank through line F2. The desired water level can be gauged visually or automatic mechanism can be provided to stop the fill operation when a desired level is reached. In this regard, an outer float chamber 87 can be provided as seen in FIG. 8 with an internal float and mechanism for gauging the position of the float.

At the end of the filling operation, pump P2 is stopped and valve V2 is shifted back to its "A" position shown in solid lines for continuing to circulate water from storage through the filter, heater and bromine injector and back to storage. If massaging turbulence of the water is desired, the "jets" button 88 is pressed which actuates pump P2 and shifts valves V3 and V5 to their broken line or "B" positions while keeping valve V4 in its solid line or "A" position. In such condition, water is drawn from the exercise tank through line D2, port B of valve V3 to the inlet of pump P2, and is discharged through port A of valve V4 and port B of valve V5 to the jet nozzles which can be of the same type commonly used in hot tubs with adjustable aeration. Such nozzles can be mounted in the vertical row of holes 89 in the side panels 15 and 16 shown in FIG. 5.

At the conclusion of the exercise or therapy procedure, the "drain" button 90 is pressed which actuates both pumps, but with valves V1, V3 and V4 in their "B" positions and valve V2 in its "A" position. Pump P1 draws water from the exercise tank through line D1 and the B port of valve V1 and discharges it through the A port of valve V2 into storage. Pump P2 draws water thorugh line D2 and the B port of valve V3 and discharges it through the B port of valve V4 into storage. Preferably, shut-off is automatic by automatic detection of the position of the float inside the vertical chamber 87 shown in FIG. 8. FIG. 8 also illustrates the four openings 91 in the end of the base unit where lines or conduits F1, D1, F2 and D2 can connect.

Both pumps are used during the filling and draining operations for the quickest possible operation, yet additional pumps are not required for circulating water to clean, heat and sanitize it and to inject water in turbulence-producing jets.

An additional "panic" button 92 is provided for emergency draining in addition to immediately stopping operation of the treadmill. Preferably, the panic condition can also be acutated by the user at will and will be automatically actuated if the user stumbles or falls. As diagrammatically represented in FIG. 12, a flexible strap 93 can be attached to the user such as by a loop around the user's wrist. Such strap is connected to a magnet 94 normally positioned over a magnetic reed switch 95 below the top apron of the exercise tank. If the magnet is dislodged either deliberately or inadvertently by the user, the panic condition is automatically instituted, resulting in immediate draining of the exercise tank and stopping of the treadmill motor.

We claim:

1. A kit for making an exercise therapy device, said kit comprising a unitary base unit having a horizontally extending bottom portion and a continuous wall extending upward from said bottom portion and forming an open-topped central cavity, a support and mounting flange extending horizontally from the upper portion of said wall and encircling the upper portion of said central cavity, a treadmill including a pair of rollers and an endless belt extending around said rollers so as to have an upper run and a bottom run, said treadmill being mounted in said central cavity such that said upper run is disposed at a height no higher than the height of said support and mounting flange, separate sidewall panels and end panels each having a bottom horizontal flange for attachment to said support and mounting flange of said base unit, said panels being connectible to each other and to said base unit to form a substantially watertight composite tank, a water storage container adapted to be connected with its interior in communication with said composite tank, pump means for transferring water from said container to said tank to fill said tank with water above said treadmill to a desired level, and means for rotating at least one of said treadmill rollers for corresponding movement of said upper run of said treadmill belt with a user supported thereon.

2. The kit defined in claim 1, in which the base unit includes an integral peripheral trough extending around the bottom portion of the base unit at a location spaced outward from and below the horizontal support and mounting flange.

3. The kit defined in claim 2, including a sensor for detecting water above a predetermined level in the peripheral trough.

4. The kit defined in claim 1, in which the water storage container includes a plurality of separate receptacles secured together and having internal cavities in communication to form a composite storage container.

5. The kit defined in claim 4, and control means for controlling operation of said pump means, said control means being adapted to be mounted on one of the separate storage receptacles.

6. The kit defined in claim 5, in which the pump means includes two separate pumps and the control means includes means for controlling both of said pumps to draw water from the storage container and discharge it into the exercise tank and, alternatively, to control both pumps to draw water from the exercise tank and discharge it to the storage container, said exercise tank including a plurality of nozzles interconnected with one of said pumps for injecting water into the tank in a form of agitating jets, the control means further including means for selectively directing water from the storage container to one of said pumps through said nozzles and back from the exercise tank to the storage container.

7. The kit defined in claim 5, in which the control means includes emergency shutoff and draining means connected to the user for automatically actuating draining of the tank by the pump means.

8. The kit defined in claim 1, in which one of the end panels forms an upright frame member, and including a door member and hinges mounting said door member on said frame member for swinging about an upright edge portion into the exercise tank, means for locking the door member in closed position, and sealing means constructed and arranged to permit outward-translating movement of the door member by pressure of water against it as the exercise tank is filled without applying stress to said hinges or locking means.

9. The kit defined in claim 8, in which the sealing means of the frame member includes outer marginal portions along opposite upright edges and the bottom of such frame member, the door member being adapted to engage against said marginal portions of the frame member and including a continuous slot and resilient gasket means mounted in said slot and adapted to enagage against said frame member marginal portions, whereby outward pressure applied against the door member by water in the exercise tank tends to translate the door member outward without applying stress to the hinges and locking means and compresses the resilient gasket means between the frame member and the door member.

* * * * *